United States Patent [19]

Cohen

[11] Patent Number: 4,752,021

[45] Date of Patent: Jun. 21, 1988

[54] GARMENT DISPLAY DEVICE

[76] Inventor: Leonard Cohen, 414 N. Sheppard St., Richmond, Va. 23221

[21] Appl. No.: 95,834

[22] Filed: Sep. 14, 1987

[51] Int. Cl.[4] ..... A41H 5/00

[52] U.S. Cl. ..... 223/68

[58] Field of Search ..... 223/66, 68, 120

[56] References Cited

U.S. PATENT DOCUMENTS

| | | | |
|---|---|---|---|
| 233,239 | 10/1880 | Hall . | |
| 236,887 | 1/1881 | Hall . | |
| 905,333 | 12/1908 | Levin . | |
| 2,628,747 | 2/1953 | Smith | 223/68 |
| 2,885,131 | 5/1959 | Reed | 223/68 |
| 2,967,006 | 1/1961 | Sykes | 223/120 X |
| 3,294,295 | 12/1966 | Wolf . | |
| 3,866,807 | 2/1975 | Parr . | |
| 3,998,366 | 12/1976 | Cannon et al. . | |
| 4,592,496 | 6/1986 | Nishi . | |

FOREIGN PATENT DOCUMENTS

| | | | |
|---|---|---|---|
| 145817 | 3/1952 | Australia | 223/68 |
| 329230 | 5/1958 | Switzerland | 223/66 |
| 675986 | 7/1952 | United Kingdom | 223/68 |
| 761379 | 11/1956 | United Kingdom | 223/68 |
| 826764 | 1/1960 | United Kingdom | 223/68 |

*Primary Examiner*—Robert R. Mackey

*Attorney, Agent, or Firm*—Norman B. Rainer

[57] ABSTRACT

A garment display device having various adjustable features is provided for displaying historical garments in a realistic manner. The device employs telescoping members held upright by a weighted base. Adjustably positionable upon the telescoping members are a waist form member, a hip form member and a torso shape. The hip form member has a number of bendable elongated ribs radially emergent from a center hub on an upright telescoping member, and adapted to display a dress in proper deployment. The uppermost upright telescoping member is deformable in a manner to dispose the torso shape in various life-like poses.

7 Claims, 2 Drawing Sheets

GARMENT DISPLAY DEVICE

BACKGROUND OF THE INVENTION

This invention concerns an adjustable device for displaying garments so as to realistically simulate the manner in which the garments would be worn.

Museums generally display clothing of earlier eras in collections intended to illustrate historical changes and cultural differences. Much of the clothing of earlier times, especially women's dresses, are extended away from the body at the waistline.

In order to properly display such clothing, it has been common practice to construct separate and special mannequin-like forms upon which articles of clothing may be draped. However, the construction of numerous support forms, each having particular fixed lateral protrusions, height and head and arm structure, is of considerable expense.

Dress-making forms of an adjustable nature have been disclosed in U.S. Pat. Nos. 236,887; 905,333; 3,866,807; 3,998,366; 4,592,496; and elsewhere. Such forms are generally of complex construction and generally adapted to hold fragments of cloth during the interattachment thereof to form a garment of desired size and shape.

Adjustable mannequins disclosed in U.S. Pat. No. 3,294,295 and elsewhere are adapted to display upper garments, namely those worn above the waistline, and lower garments in life-like presentations. Such mannequins however, generally require the use of expensive molded cavity components of fixed size and shape, and usually lack sufficient positional adjustability to achieve varied poses.

It is accordingly an object of the present invention to provide a device for the full length display of garments in their life-like, as-worn appearance.

It is a further object of this invention to provide a device as in the foregoing object having sufficient adjustability to accommodate various styles of clothing in different realistic poses.

It is another object of the invention to provide a device of the aforesaid nature constructed of materials that will not chemically react with the fabric or dye of the garment over long periods of time.

It is a still further object of the present invention to provide a device of the aforesaid nature of rugged and durable construction amenable to low cost manufacture.

These objects and other objects and advantages of the invention will be apparent from the following description.

SUMMARY OF THE INVENTION

The above and other beneficial objects and advantages are accomplished in accordance with the present invention by a garment display device comprising:

(a) a weighted base having a substantially flat bottom surface, (b) an upright straight hollow post centered upon said base, (c) a first extension of straight, hollow construction adapted to telescopically slide within said post, (d) a second extension having (1) a straight lower extremity adapted to telescopically slide within said first extension, (2) a middle portion, and (3) a straight upper extremity, (e) locking means adapted to prevent unwanted sliding movement between said post and first and second extensions, (f) a waist form member of generally cylindrical shape axially disposed upon the lower extremity of said second extension in slidable engagement therewith, (g) a hip form member slidably positioned below said waist form and comprised of between about 5 and 10 bendable elongated ribs radially emergent from a center hub axially disposed upon said first or second extension, and elongated resilient pads associated with said ribs, and (h) a torso shape positioned upon the upper extremity of said second extension, and equipped with means for the releasible attachment of arm and head members in adjustable orientations with respect to said torso shape.

In preferred embodiments, the middle portion of the second extension is bendable and is comprised of a spiral metal coil of the type employed on gooseneck lamps. Two of the elongated resilient pads may be longer than the other pads and intended to accommodate bustle-type women's dresses. The surfaces of the waist form and torso shape are such as to receive and hold penetrative fasteners such as pins and staples.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 5:
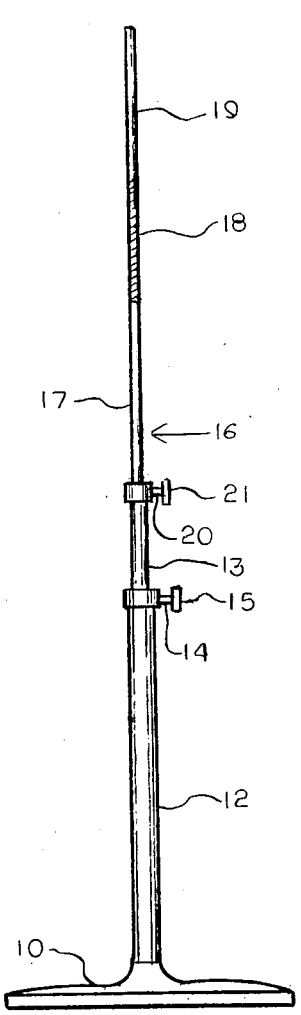
FIG. 5 is a side view of the device of FIG. 1 with several component parts removed therefrom.
Figure 2:
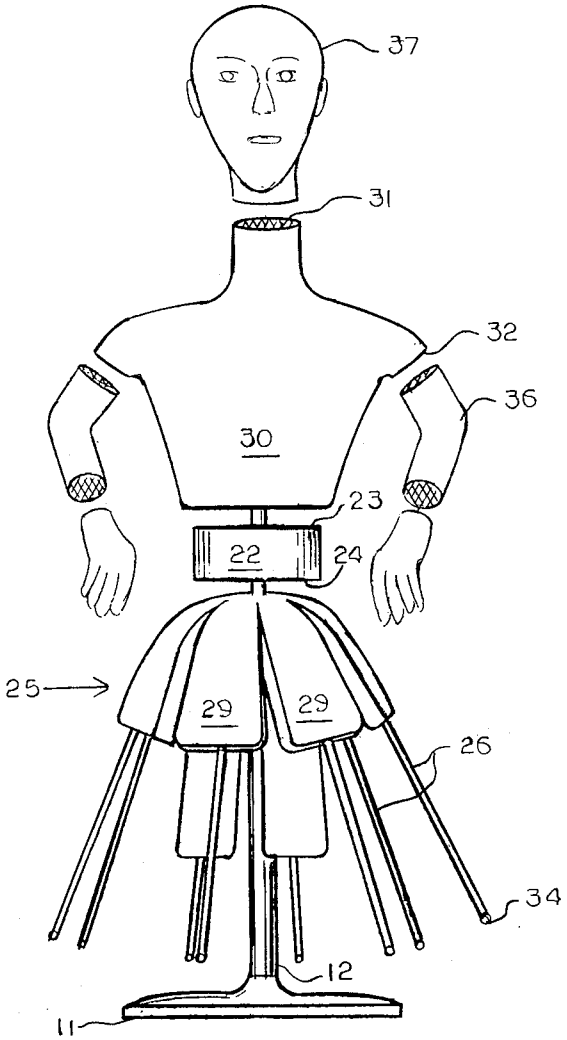
FIG. 2 is a front view of the device shown in FIG. 1.
Figure 1:
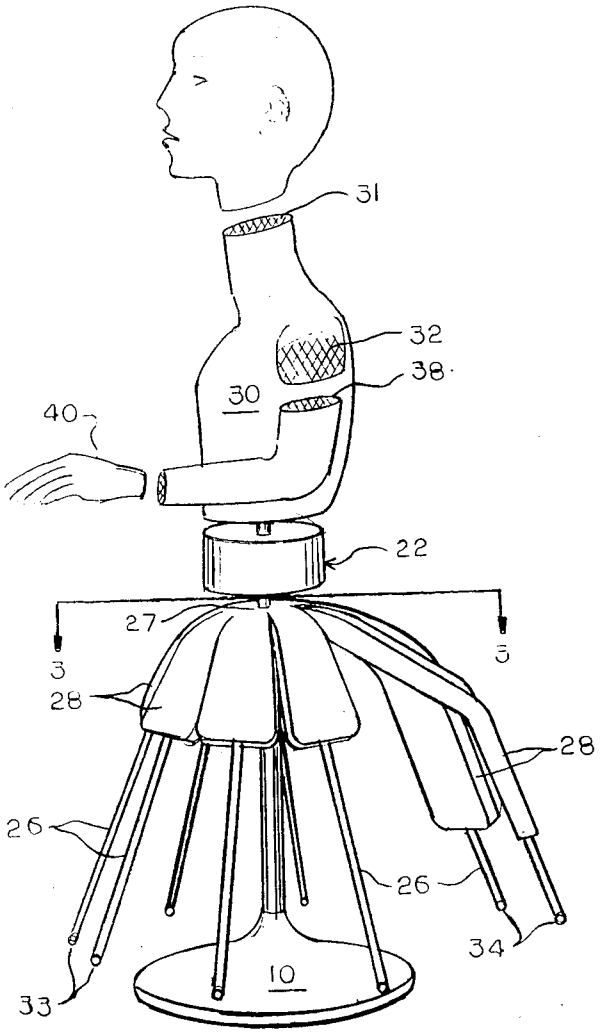
FIG. 1 is a perspective view of an embodiment of the garment display device of this invention.

Referring to FIGS. 1–5, an embodiment of the garment display device of this invention is shown comprised of weighted base 10 of circular contour having a flat bottom surface 11, and a straight hollow post 12 rising vertically upward from the center of said base. A first extension 13 of straight metal tubular construction telescopically slides within post 12. A set screw 14, having a knurled turning knob 15, perpendicularly penetrates post 12 to engage extension 13.

A second extension 16 is comprised of: (1) a straight lower extremity 17 adapted to telescopically slide within first extension 13, (2) a bendable middle portion 18 fabricated of a metal spiral as used in conventional gooseneck lamps, and (3) a straight upper extremity 19. Upper and lower extremities 19 and 17, respectively, are of substantially equal length. A set screw 20, having a knurled turning knob 21, perpendicularly penetrates first extension 13 to engage the lower extremity 17 of said second extension 16.

A waist form member 22 of cylindrical shape is axially disposed upon the lower extremity 17 of said second extension, and slidably positionable thereupon. In alternative embodiments, waist form member 22 may be disposed upon first extension 13. The shape of said waist form member is such that its diameter is between about 2.5 and 5 times greater than its height, measured between upper surface 23 and lower surface 24. The waist form member is preferably fabricated of a semi-rigid foamed plastic such as polystyrene, polyethylene and polyurethane.

Figure 4:
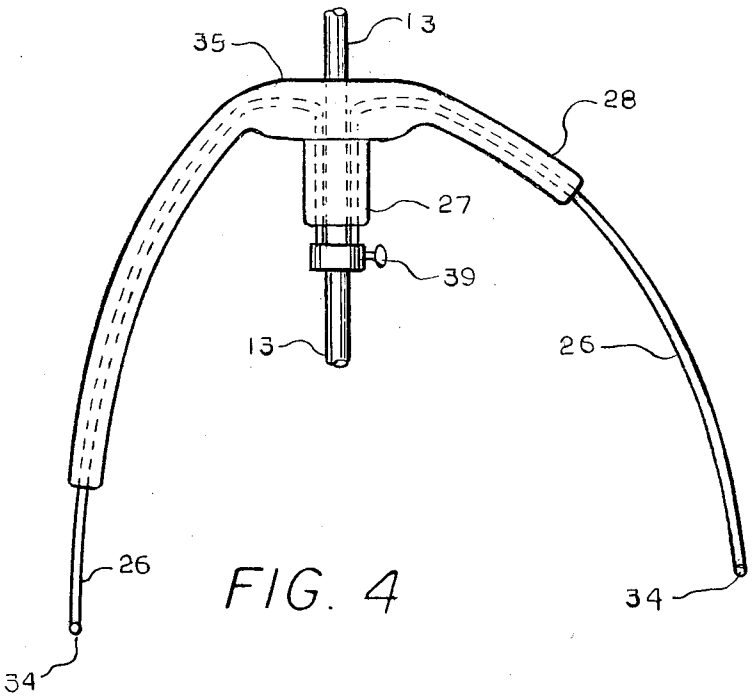
FIG. 4 is a sectional view taken along the line 4—4 of FIG. 3.
Figure 3:
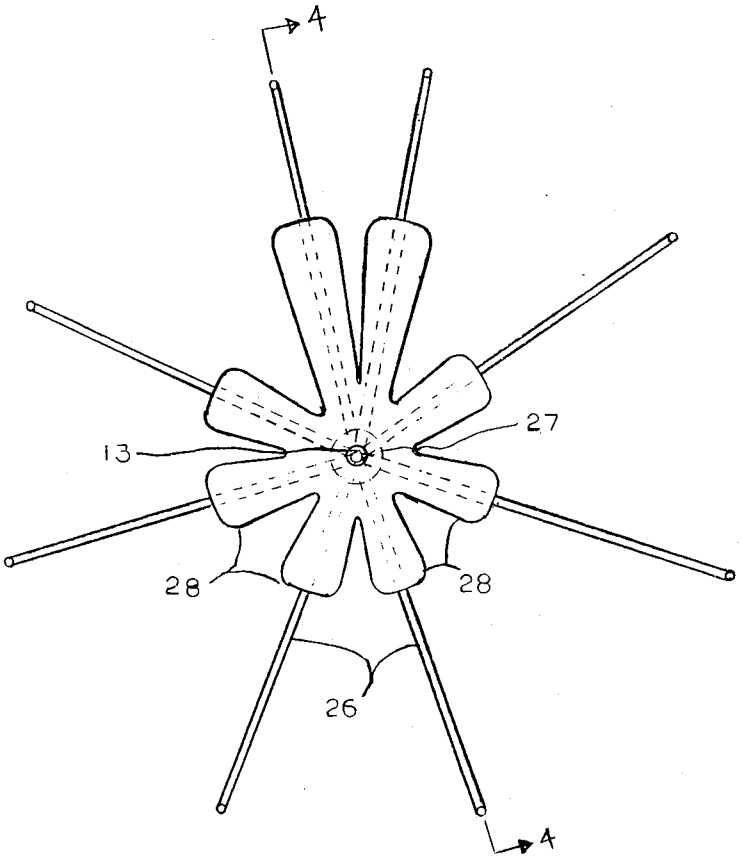
FIG. 3 is a sectional view taken along the line 3—3 of FIG. 1.

A hip form member 25 is slidably positioned below said waist form member, and, as best shown in FIGS. 3 and 4, is comprised of eight bendable elongated wire ribs 26 radially emergent and downwardly directed from a collar 27 slidably disposed upon said first extension and provided with set screw 39. The lowermost extremities 33 of the ribs hold plastic caps 34 which prevent damage to the garment by the ribs. Elongated styrafoam pads 28 emerge from a central region 35 above collar 27 and extend along the ribs in embracing or engulfing relationship therewith. Such association of its styrafoam pads with the ribs may be achieved either by insertion of the ribs through channels in the pads, or molding the pads upon the ribs. The pads are of substantially rectangular cross-sectional configuration, having at least one upwardly directed flat surface 29. Said flat surfaces are intended to provide stress-free support to the skirt portion of women's clothes. By manually bending the several ribs to desired positions, the skirt or bustle portion of the dress can be displayed in its originally intended fullness. It is to be noted that two of the pads 28 extend further from collar 27, and are intended to support bustle-back portions of a dress.

A torso shape 30 having a hollow interior is positioned upon said second extension. The torso is provided with flat head and arm connecting surfaces 31 and 32, respectively, each covered with Velcro material 38 capable of making secure contact attachment with arm and head forms 36 and 37, respectively, provided with matching flat connecting surfaces having cooperative Velcro material. In alternative embodiments, other mechanical fastening means such as buttons, snaps and zippers may be utilized to attach the arm and head members to the torso. By virtue of such manner of attachment, head, arm and hand shapes 40 can be attached in various orientations to torso 30.

In view of its specialized construction, the device of this invention can safely support historical garments of many kinds for museum purposes in various realistic modes of expression. Those portions of the device which directly contact the garment are fabricated of materials which will have no long term deleterious effect upon the garment.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A garment display device comprising:

(a) a weighted base having a substantially flat bottom surface, (b) an upright straight hollow post centered upon said base, (c) a first extension of straight, hollow construction adapted to telescopically slide within said post, (d) a second extension having (1) a straight lower extremity adapted to telescopically slide within said first extension, (2) a middle portion, and (3) a straight upper extremity, (e) locking means adapted to prevent unwanted sliding movement between said post and first and second extensions, (f) a waist form member of generally cylindrical shape axially disposed upon one of said first and second extensions in slidable engagement therewith, (g) a hip form member slidably positioned below said waist form member and comprised of between about 5 and 10 bendable elongated ribs radially emergent from a center hub axially disposed upon one of said first and second extensions, and elongated resilient pads associated with said ribs, and (h) a torso shape positioned upon said second extension, and equipped with means for the releasible attachment of arm and head members in adjustable orientations with respect to said torso shape.

2. The device of claim 1 wherein the middle portion of said second extension is comprised of a bendable spiral metal coil of the type employed on gooseneck lamps.

3. The device of claim 2 wherein two of the elongated resilient pads associated with said ribs are larger than the remaining pads and are adapted to accommodate bustle-type women's dresses.

4. The device of claim 2 wherein the surfaces of the waist form member and torso shape are such as to receive and hold penetrative fasteners.

5. The device of claim 2 wherein the waist form member is configured such that its diameter is between about 2.5 and 5 times greater than its height.

6. The device of claim 2 wherein the waist form member and the resilient pads associated with said ribs are fabricated of a resilient foam of a synthetic plastic that is inert to the fibers and dyes of the garment.

7. The device of claim 6 wherein said plastic is a member selected from the group consisting of polyethylene and polystyrene.

* * * * *